US007753371B2

(12) United States Patent
Gudaitis et al.

(10) Patent No.: US 7,753,371 B2
(45) Date of Patent: Jul. 13, 2010

(54) MEDIA JAM AND BENT CORNER DETECTOR

(75) Inventors: Algird M Gudaitis, Vancouver, WA (US); Tod S. Heiles, Vancouver, WA (US); Kit Hui, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 516 days.

(21) Appl. No.: 11/302,027

(22) Filed: Dec. 12, 2005

(65) Prior Publication Data

US 2007/0134008 A1 Jun. 14, 2007

(51) Int. Cl.
*B65H 7/02* (2006.01)

(52) U.S. Cl. ..... 271/265.01; 271/258.01

(58) Field of Classification Search ..... 271/258.01, 271/265.01; 347/139, 164, 193, 215; 400/120.13
See application file for complete search history.

(56) References Cited

U.S. PATENT DOCUMENTS

| | | | | |
|---|---|---|---|---|
| 5,192,141 | A | 3/1993 | Chung et al. | |
| 5,655,668 | A * | 8/1997 | Drenth | 209/603 |
| 6,065,746 | A * | 5/2000 | Tranquilla | 271/176 |
| 6,382,917 | B1 * | 5/2002 | Zuege | 416/210 R |
| 6,435,641 | B1 | 8/2002 | Tung et al. | |
| 6,637,852 | B2 * | 10/2003 | Bjune | 347/16 |
| 6,731,393 | B1 | 5/2004 | Currans et al. | |

FOREIGN PATENT DOCUMENTS

DE 4023411 A1 * 2/1992

* cited by examiner

*Primary Examiner*—Patrick H Mackey
*Assistant Examiner*—Michael C McCullough

(57) ABSTRACT

This invention relates to a media jam and media bent corner detector, comprising: a carriage; a transducer operatively connected to or adjacent to the carriage; and a piezoelectric film beam operatively connected to the transducer such that a portion of the beam substantially extends into a media path to detect the presence of a media jam or a media bent corner.

25 Claims, 7 Drawing Sheets

MEDIA JAM AND BENT CORNER DETECTOR

BACKGROUND OF THE INVENTION

1. Field of the Invention

This invention relates to a media jam and media bent corner detector, comprising: a carriage; a transducer operatively connected to or adjacent to the carriage; and a piezoelectric film beam operatively connected to the transducer such that a portion of the beam substantially extends into a media path to detect the presence of a media jam or a media bent corner.

2. Description of the Related Art

In a high reliability, high speed printing mechanism, it is critical to know if media is jamming up against or under the print heads or if a bent over corner is likely to contact the underside of the print heads. In a paper jam condition, multiple sheets will pile up quickly, making it hard to clear the jam. Also, if the mechanism continues to try to move for media along, it will often shift the print head positions, thereby causing subsequent color printing alignment problems. Bent over corners may cause a problem because they may extend above the paper support surface enough to make contact with the print head nozzles. This could lead to the transfer of objectionable amounts of ink/toner from a print head onto the media which may then carry and transfer the ink/toner onto the next print head. This may then cause a mixing of ink types that could lead to a chemical reaction that clogs the print head. With this in mind, it is known that space and tolerance constraints make it difficult to provide a reliable but inexpensive sensor that can detect a bent piece of media or the beginning of a media jam. Consequently, a more advantageous sensor, then, would be provided if it was reliable and inexpensive and could detect a bent piece of media and/or the beginning of the media jam.

It is apparent from the above that there exists a need in the art for a sensor that is reliable and inexpensive, but which at the same time can detect a bent piece of media and/or the beginning of the media jam. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a media jam and media bent corner detector, comprising: a carriage; a transducer operatively connected to or adjacent to the carriage; and a piezoelectric film beam operatively connected to the transducer such that a portion of the beam substantially extends into a media path to detect the presence of a media jam or a media bent corner.

In certain preferred embodiments, the transducer is further comprised of a printed circuit assembly. Also, the piezoelectric film beam is further comprised of a polyvinylidene fluoride (PVDF) piezoelectric film beam. Finally, the detector further comprises isolation grommets and a heavy bracket to prevent high frequency vibrations and shock from being transferred from the carriage to the detector.

In another further preferred embodiment, a reliable and inexpensive detector is presented which can detect a bent piece of media and/or the beginning of the media jam.

The preferred media jam and media bent corner detector, according to various embodiments of the present invention, offers the following advantages: ease-of-use; excellent media jam detecting characteristics; excellent media bent corner detection characteristics; lightness in weight; improved reliability; and reduced cost. In fact, in many of the preferred embodiments, these factors of media jam detecting characteristics, media bent corner detection characteristics, reliability, and cost are optimized to an extent that is considerably higher than heretofore achieved in prior, known media jam and media bent corner detectors.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
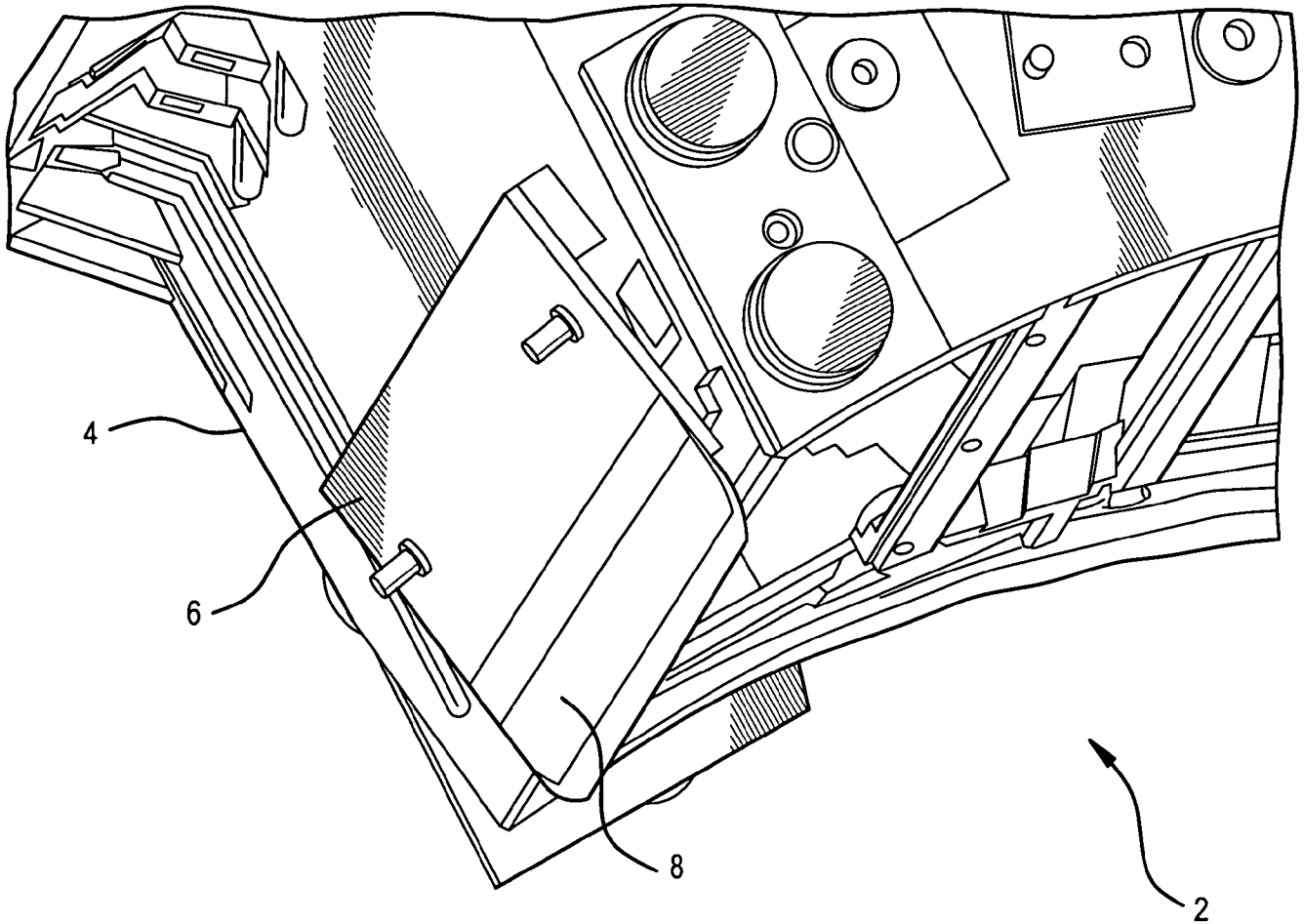
FIG. 1 illustrates a media jam and media bent corner detector assembly, according to one embodiment of the present invention.

With reference first to FIG. 1, there is illustrated one preferred embodiment for use of the concepts of this invention. FIG. 1 illustrates media jam or media bent corner detector assembly 2. Assembly 2 includes, in part, carriage 4, transducer 6, and piezoelectric film beam 8. Transducer 6, preferably, is constructed of a printed circuit assembly (PCA) that is rigidly attached to carriage 4. Piezoelectric film beam 8, preferably, is constructed of a polyvinylidene fluoride (PVDF) piezoelectric film beam that is rigidly attached along one end to transducer 6 such that a portion of piezoelectric film beam 8 extends below transducer 6 and into a media path. It is to be understood that piezoelectric film beam 8 should extend at least across the entire width of the media to be measured. It is also to be understood that transducer 6 and piezoelectric film beam 8 can be located away from the carriage 4.

Figure 2:
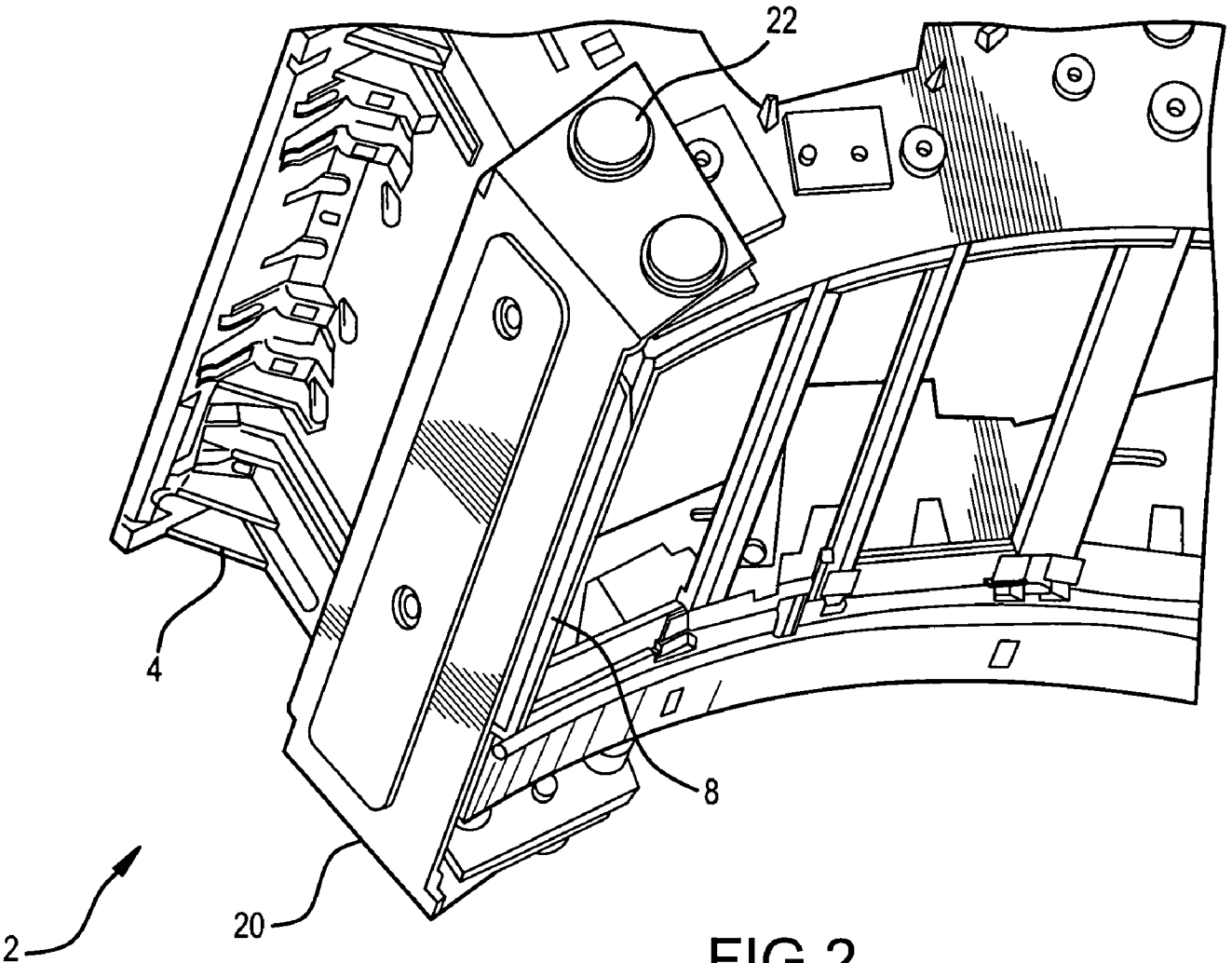
FIG. 2 illustrates the media jam and media bent corner detector assembly with the grommets and bracket attached, according to another embodiment of the present invention.

With respect to FIG. 2, bracket 20 is placed over piezoelectric film beam 8 and secured by isolation grommets 22 to prevent high frequency vibrations and shock from being transferred from carriage 4 to assembly 2. Bracket 20, preferably, is constructed of any suitable, durable, high strength material that is capable of retaining transducer 6 and piezoelectric film beam 8 in place. Isolation grommets 22 are used to secure bracket 20 onto carriage 4. As can be seen in FIG. 2, a portion of piezoelectric film beam 8 extends below carriage 4 and bracket 20.

Figure 3:
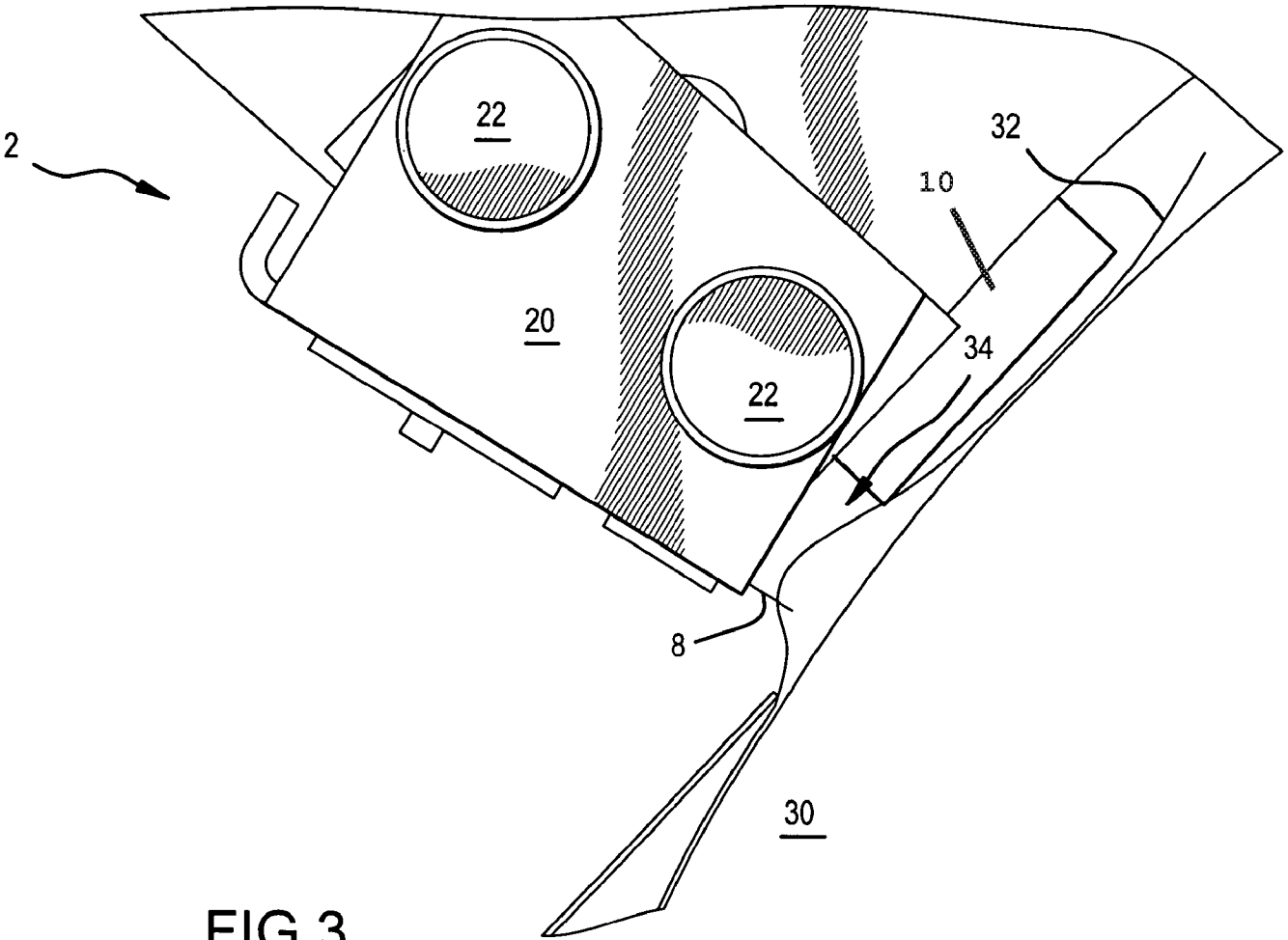
FIG. 3 shows how a piece of media that is jammed interacts with the media jam and media bent corner detector assembly, according to another embodiment of the present invention.

With respect to FIG. 3, under normal circumstances media 32 passes below piezoelectric film beam 8. However, if a sheet of media 32 becomes jammed, typically a portion 34 of the media 32 extends above drum 30. When portion 34 extends above drum 30, portion 34 contacts piezoelectric film beam 8. This contact with piezoelectric film beam 8 causes piezoelectric film beam 8 to bend or deform. This bending strains transducer 6 and generates an electric charge that is amplified and thresholded to generate a firmware interrupt within a driving circuit (not shown) for driving drum 30. The firmware interrupt is used to determine the presence of a media jam or media bent corner. It is to be understood that while a media jam has been shown in FIG. 3, a media bent corner would also extend above the drum 30, contact piezoelectric film beam 8 and cause piezoelectric film beam 8 to deform.

Figure 4:
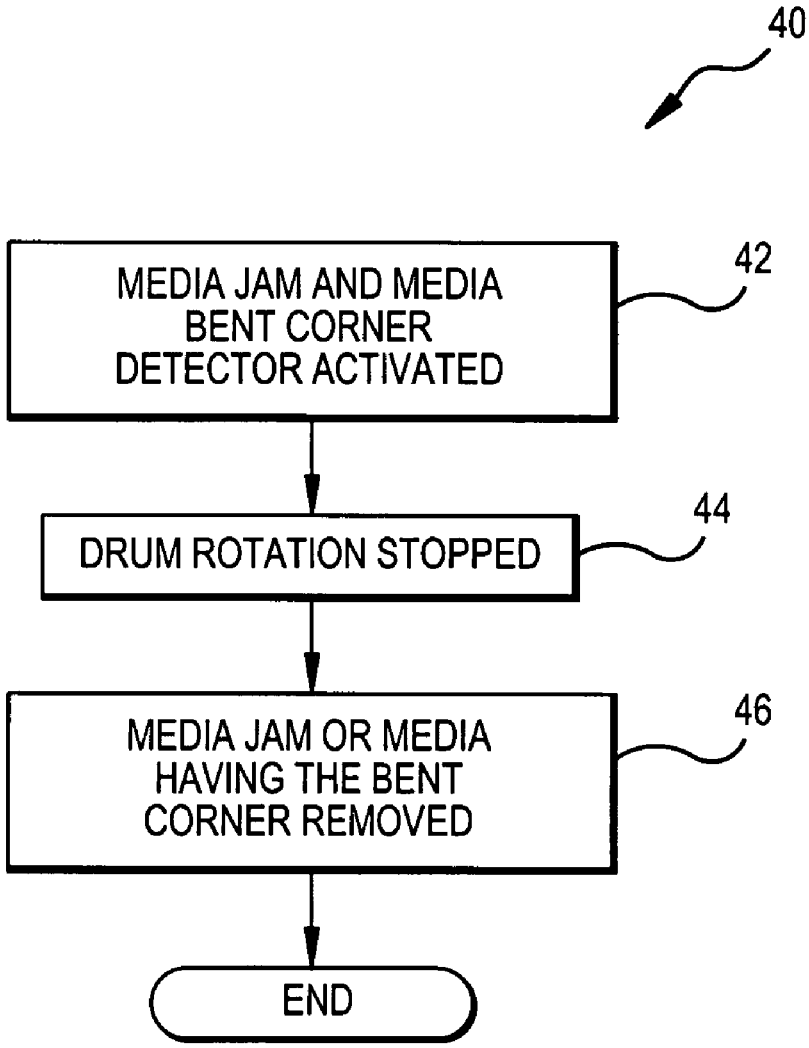
FIG. 4 is a flowchart of a method for interrupting a print job when a media jam or media bent corner has been detected, according to another embodiment of the present invention.

Various usages of assembly 2 will now be described. With respect to FIG. 4, a method 40 for interrupting a print job when a media jam or media bent corner has been detected is shown. Method 40 includes, but is not limited to, the steps of actuating assembly 2 (FIG. 1) when a media jam or a media bent corner contacts piezoelectric film beam 8 (FIG. 3) (step 42). Stopping the rotation of drum 30 (FIG. 2) by the firmware interrupt (step 44). Finally, the media jam or the media having a bent corner is removed (step 46). It is to be understood that a variety of conventional techniques can be employed to assist the user in removing the media jam or the bent corner media. For example, lights can be illuminated to show where the jam/bent corner media is located. Also, graphics on the user interface can show where the jam/bent corner media is located. It is to be understood that the actuating steps 42-72 in methods 40-70, respectively, can be further utilized to determine if the jam/bent corner media has been cleared.

Figure 5:
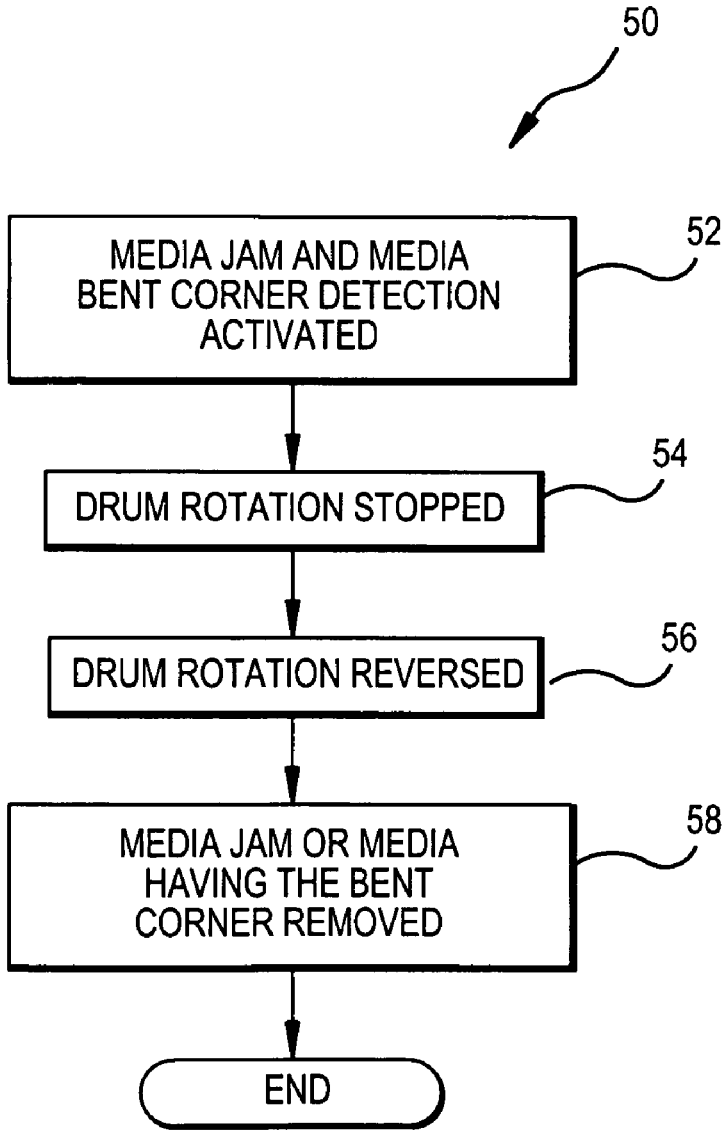
FIG. 5 is a flowchart of another method for interrupting a print job when a media jam or media bent corner has been detected, according to another embodiment of the present invention

With respect to FIG. 5, another method 50 for interrupting a print job when a media jam or media bent corner has been detected is shown. Method 50 includes, but is not limited to, the steps of actuating assembly 2 (FIG. 1) when a media jam or a media bent corner contacts piezoelectric film beam 8 (FIG. 3) (step 52). Stopping the rotation of drum 30 (FIG. 2) by the firmware interrupt (step 54). Reversing the rotation of drum 30 to allow for the removal of the media jam or the media having a bent corner (step 56). It is to be understood that the flow of the media path can be conventionally reversed to allow for the removal of the media jam or the media having a bent corner. Finally, the media jam or the media having a bent corner is removed (step 58).

Figure 6:
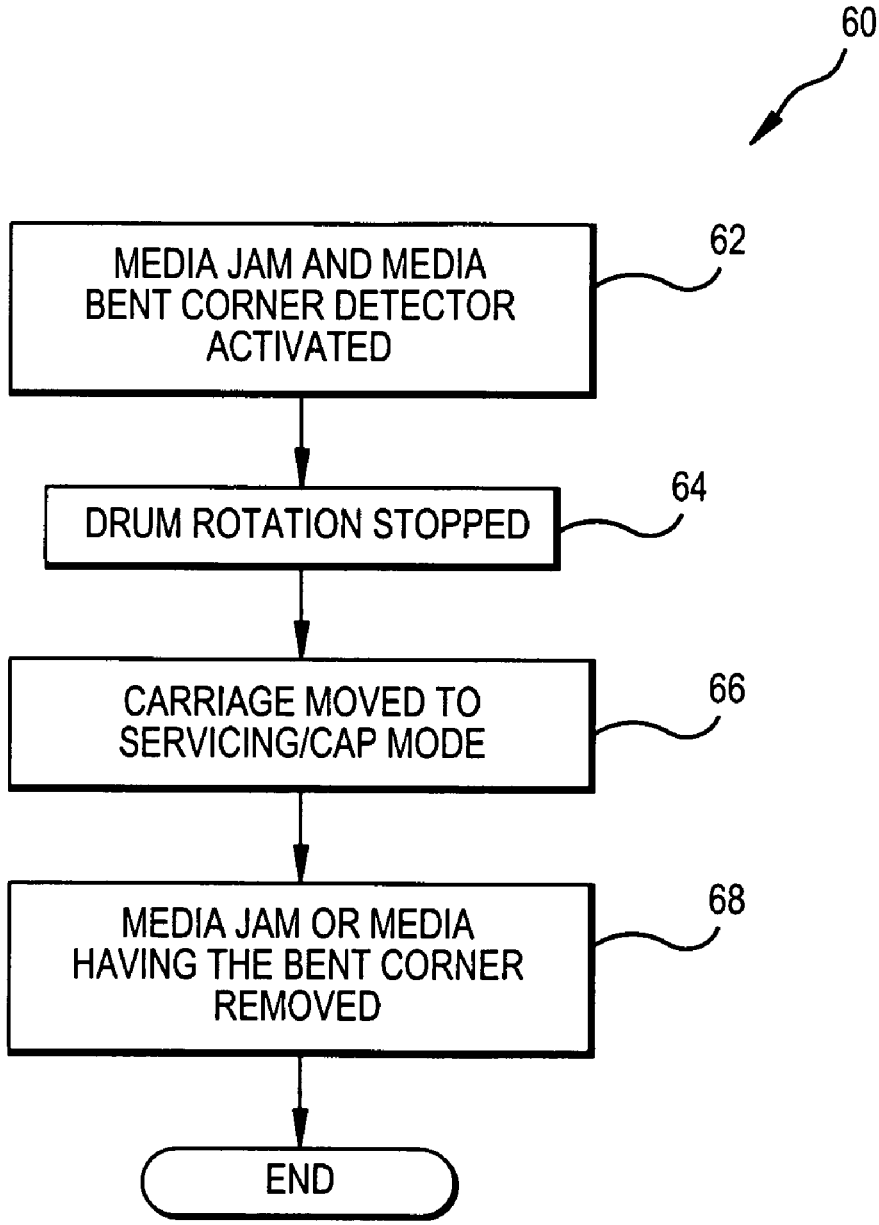
FIG. 6 is a flowchart of a method for moving the carriage to a service/capping mode when a media jam or media bent corner has been detected, according to another embodiment of the present invention.

With respect to FIG. 6, a method 60 for moving the carriage to a service/capping mode when a media jam or media bent corner has been detected is shown. Method 60 includes, but is not limited to, the steps of actuating assembly 2 (FIG. 1) when a media jam or a media bent corner contacts piezoelectric film beam 8 (FIG. 3) (step 62). Stopping the rotation of drum 30 (FIG. 2) by the firmware interrupt (step 64). Moving the carriage 4 to a servicing/capping mode such that the print head 10 (FIG. 3) can be conventionally serviced and/or capped (step 66). The print head is then conventionally serviced and/or capped. Finally, the media jam or the media having a bent corner is removed (step 68).

Figure 7:
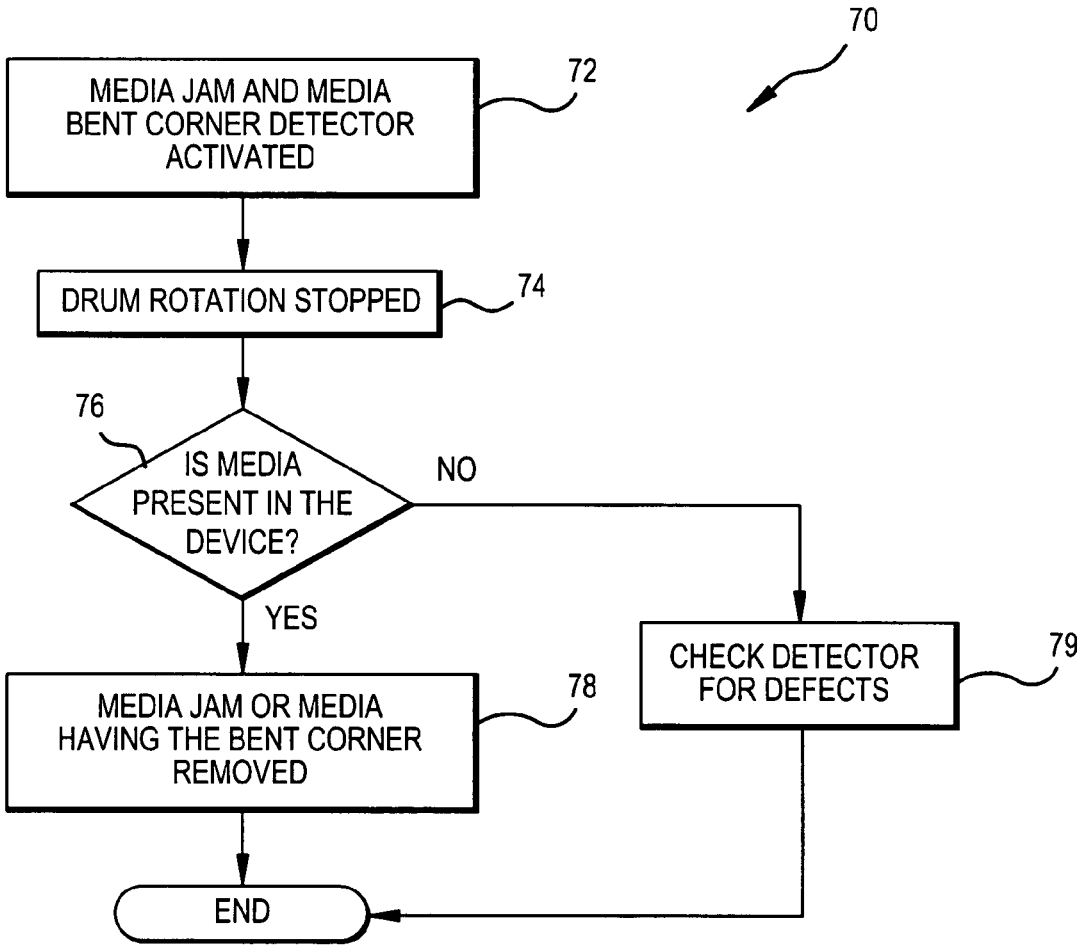
FIG. 7 is a flowchart of a method for determining if a media jam or media bent corner has been detected, according to another embodiment of the present invention.

With respect to FIG. 7, a method 70 for determining if a media jam or media bent corner has been detected is shown. Method 70 includes, but is not limited to, the steps of actuating assembly 2 (FIG. 1) when a media jam or a media bent corner contacts piezoelectric film beam 8 (FIG. 3) (step 72). Stopping the rotation of drum 30 (FIG. 2) by the firmware interrupt (step 74). Determining if media is present in the device (step 76). If media is present in the device then the media jam or media having the bent corner is removed (step 78). However, if media is not present in the device, the assembly 2 is checked for defects (step 79). One of the purposes of method 70 is to detect if carriage 4 is creating high frequency vibrations or shock and transferring these to assembly 2. Even though media may not be present in assembly 2, a false reading may still result from the vibrations or shock as carriage 4 shuttles back and forth. In this instance, carriage 4 may need to be serviced or replaced.

It is to be understood that the flowchart of FIGS. 4-7 show the architecture, functionality, and operation of one implementation of the present invention. If embodied in software, each block may represent a module, segment, or portion of code that comprises one or more executable instructions to implement the specified logical function(s). If embodied in hardware, each block may represent a circuit or a number of interconnected circuits to implement the specified logical function(s).

Also, the present invention can be embodied in any computer-readable medium for use by or in connection with an instruction-execution system, apparatus or device such as a computer/processor based system, processor-containing system or other system that can fetch the instructions from the instruction-execution system, apparatus or device, and execute the instructions contained therein. In the context of this disclosure, a "computer-readable medium" can be any means that can store, communicate, propagate or transport a program for use by or in connection with the instruction-execution system, apparatus or device. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable medium could even be paper or another suitable medium upon which the program is printed, as the program can be electronically captured, via, for instance, optical scanning of the paper or other medium, then compiled, interpreted or otherwise processed in a single manner, if necessary, and then stored in a computer memory.

Those skilled in the art will understand that various embodiment of the present invention can be implemented in hardware, software, firmware or combinations thereof. Separate embodiments of the present invention can be implemented using a combination of hardware and software or firmware that is stored in memory and executed by a suitable instruction-execution system. If implemented solely in hardware, as in an alternative embodiment, the present invention can be separately implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In preferred embodiments, the present invention can be implemented in a combination of software and data executed and stored under the control of a computing device.

It will be well understood by one having ordinary skill in the art, after having become familiar with the teachings of the present invention, that software applications may be written in a number of programming languages now known or later developed.

Although the flowcharts of FIGS. 4-7 show a specific order of execution, the order of execution may differ from that which is depicted. For example, the order of execution of two or more blocks may be scrambled relative to the order shown. Also, two or more blocks shown in succession in FIGS. 4-7 may be executed concurrently or with partial concurrence. All such variations are within the scope of the present invention.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A media jam and media bent corner detector, comprising:

a print head carriage in which a print head is supported;

a transducer operatively connected to the print head carriage; and a piezoelectric film beam operatively connected to the transducer and supported by the print head carriage such that a detection portion of the beam substantially extends into a media path formed by a media support surface to detect the presence of a media jam or a media bent corner in the media path, wherein the detection portion of the beam is spaced from the media support surface.

2. The detector, as in claim 1, wherein the detector is further comprised of:

a bracket located substantially over the transducer and the piezoelectric film beam and attached to the print head carriage.

3. The detector, as in claim 2, wherein the bracket is further comprised of:

a plurality of isolation grommets such that the grommets attach the bracket to the print head carriage.

4. The detector, as in claim 2, wherein the detection portion of the piezoelectric film beam extends from the print head carriage and the bracket into the media path.

5. The detector, as in claim 1, wherein the transducer is further comprised of:

a printed circuit assembly.

6. The detector, as in claim 1, wherein the piezoelectric film beam is further comprised of:

a polyvinylidene fluoride (PVDF) piezoelectric film beam.

7. The detector, as in claim 1, wherein the piezoelectric film beam extends at least across an entire width of media in the media path.

8. The detector, as in claim 1, wherein contact of the media jam or the media bent corner with the piezoelectric film beam deforms the piezoelectric film beam and creates a strain in the transducer, wherein the strain in the transducer determines the presence of the media jam or the media bent corner.

9. The detector, as in claim 1, wherein media in the media path is supported by a media drum, wherein the media drum is stopped when the presence of the media jam or the media bent corner is detected.

10. The detector, as in claim 9, wherein, after the media drum is stopped, the media drum is reversed when the presence of the media jam or the media bent corner is detected.

11. The detector, as in claim 1, wherein the detection portion of the beam is spaced from the media support surface when media is absent from the media path.

12. A media jam and media bent corner detector, comprising:

a print head carriage spaced from a media support surface, the media support surface configured to support media in a media path;

a transducer located substantially adjacent to the print head carriage; and a piezoelectric film beam operatively connected to the transducer such that an end of the beam substantially extends from the print head carriage toward the media support surface and into the media path to detect the presence of a media jam or a media bent corner in the media path, wherein the end of the beam is spaced from the media support surface such that a gap is formed between the end of the beam and the media support surface.

13. The detector, as in claim 12, wherein the detector is further comprised of:

a bracket located substantially over the transducer and the piezoelectric film beam and attached to the print head carriage.

14. The detector, as in claim 13, wherein the bracket is further comprised of:

a plurality of isolation grommets such that the grommets attach the bracket to the print head carriage.

15. The detector, as in claim 13, wherein the end of the piezoelectric film beam extends from the print head carriage and the bracket into the media path.

16. The detector, as in claim 12, wherein the transducer is further comprised of:

a printed circuit assembly.

17. The detector, as in claim 12, wherein the piezoelectric film beam is further comprised of:

a polyvinylidene fluoride (PVDF) piezoelectric film beam.

18. The detector, as in claim 12, wherein the piezoelectric film beam extends at least across an entire width of media in the media path.

19. The detector, as in claim 12, wherein contact of the media jam or the media bent corner with the piezoelectric film beam deforms the piezoelectric film beam and creates a strain in the transducer, wherein the strain in the transducer determines the presence of the media jam or the media bent corner.

20. The detector, as in claim 12, wherein media in the media path is supported by a media drum, wherein the media drum is stopped when the presence of the media jam or the media bent corner is detected.

21. The detector, as in claim 20, wherein, after the media drum is stopped, the media drum is reversed when the presence of the media jam or the media bent corner is detected.

22. The detector, as in claim 12, wherein the end of the beam is spaced from the media support surface when media is absent from the media path.

23. The detector, as in claim 12, wherein the beam is supported by the print head carriage, and the print head carriage is configured to support a print head.

24. A media jam and media bent corner detector, comprising:

a printhead carriage supported adjacent a media path formed by a media support surface;

a printed circuit assembly supported by the printhead carriage; and a piezoelectric film beam operatively connected to the printed circuit assembly and supported by the printhead carriage such that an end of the beam substantially extends linearly from the printhead carriage and into the media path to detect the presence of a media jam or a media bent corner in the media path, wherein the end of the beam is spaced from the media support surface.

25. The detector, as in claim 24, wherein the end of the beam is spaced from the media support surface when media is absent from the media path.

* * * * *